United States Patent [19]

Giulie

[11] 4,113,394

[45] Sep. 12, 1978

[54] REMOVABLE BINDING DEVICE

[75] Inventor: Joe D. Giulie, Los Altos, Calif.

[73] Assignee: Minnesota Mining and Manufacturing Company, Saint Paul, Minn.

[21] Appl. No.: 625,131

[22] Filed: Oct. 23, 1975

[51] Int. Cl.[2] ..... B42F 3/00; B42F 13/12

[52] U.S. Cl. ..... 402/46; 402/47; 402/68; 402/75

[58] Field of Search ..... 402/68, 46, 56, 80 R, 402/47, 60; 281/19 R

[56] References Cited

U.S. PATENT DOCUMENTS

| | | | |
|---|---|---|---|
| 228,642 | 6/1880 | Jelliff | 281/19 R |
| 1,243,544 | 10/1917 | Murray | 402/68 X |
| 2,002,071 | 5/1935 | Welk | 402/80 R X |
| 2,057,514 | 10/1936 | Dawson et al. | 402/46 |
| 2,083,556 | 6/1937 | Buchan | 402/47 X |
| 3,260,264 | 7/1966 | McKowen | 402/22 |
| 3,734,634 | 5/1973 | Fenston | 402/56 |
| 3,834,739 | 10/1974 | Abildgaard et al. | 281/21 R |

FOREIGN PATENT DOCUMENTS

| | | | |
|---|---|---|---|
| 250,338 | 3/1964 | Australia | 402/47 |
| 800,994 | 5/1936 | France | 402/68 |
| 837,888 | 11/1938 | France | 402/47 |
| 1,214,198 | 4/1966 | Fed. Rep. of Germany | 402/68 |
| 144,589 | 3/1931 | Switzerland | 402/60 |
| 1,170,755 | 11/1969 | United Kingdom | 402/60 |

*Primary Examiner*—Jerome Schnall

*Attorney, Agent, or Firm*—Robert G. Slick; William L. Huebsch; John C. Barnes

[57] ABSTRACT

An inexpensive polymeric device for releasably retaining a stack of perforated paper, including a pair of rake-like members each comprising a rail supporting projecting studs. The rake-like members are assemblable by inserting studs on each through the paper perforations from opposite sides of the stack and into sockets formed on the other rail to form a ladder-like assembly engaged with the paper. The rails on the ladder-like assembly are slid into close fitting channels defined on a backing strip which extends around the spine edge of the stack to keep the rake-like members in engagement, and are retained therein by end portions of the rails adapted to engage over the ends of the channels. Subsequently a user can squeeze together on cam surfaces on the end portions of the strips to simultaneously disengage them from the ends of the channels and move them into the channels so that the ladder-like assembly can be slid out of the backing strip and disassembled.

2 Claims, 8 Drawing Figures

REMOVABLE BINDING DEVICE

BACKGROUND OF THE INVENTION

1. Field of the Invention

The present invention relates to devices for releasably binding together a stack of perforated paper, and in one aspect to such devices which are easily releasable to add or delete sheets.

2. Description of the Prior Art

The prior art is replete with devices for releasably binding together a stack of perforated paper. U.S. Pat. Nos. 1,790,693, 2,057,514, 2,120,659, 2,193,181, 2,315,303, 2,318,941 and 3,734,634 and French Pat. No. 800,994 are specifically noted.

Of the devices described in these patents, the device described in U.S. Pat. No. 2,057,514 is believed to be the closest prior art. Like the present invention, the device described in that invention includes a pair of rake-like members, each comprising a row of studs projecting from a rail and having openings in the rail shaped to receive end portions of the studs from the other rail. The studs and openings are spaced so that the rake-like members can be assembled to form a ladder-like assembly with the studs passing through the perforations in the paper and the strips on opposite sides of the stack. The device also includes a backing strip shaped to define channels with opposed open sides which channels will slidably receive the rails of the ladder-like assembly with the backing strip extending around the spine edge of the stack of sheets. The ladder assembly is releasably retained in the backing strip by end portions of the rails adapted to engage the ends of the channels defined by the backing member and to center the ladder assembly therein.

The device described in U.S. Pat. No. 2,057,514, however, is a metal structure which is more expensive than may be desired for many applications. Only projections from the rails are positioned in the opposed channels when the ladder-like assembly is slid into engagement therewith so that the channels project a greater distance beyond the rails away from the adjacent surface of the paper than is desirable to provide a compact binding device. The ends of the studs make snap engagement with the openings in the rails which restricts easy assembly and disassembly of the ladder assembly. Also the end portions of the rails are not easily disengaged from the ends of the channel member since the end portions of the rails must first be squeezed together so that they are disengaged from the ends of the channels and the ladder assembly must then be slid by a separate movement to move the end portions into the channel and afford movement of the ladder-like assembly therefrom.

SUMMARY OF THE INVENTION

The present invention provides a simple and inexpensive device for releasably binding sheets. The device has structure which makes it very compact, petite and unobtrusive, and the device is adapted to afford great ease of assembly and disassembly.

According to the present invention there is provided a device for releasably binding together a stack of perforated paper of the aforementioned type including a pair of rake-like members each comprising a row of studs projecting from a rail and having openings in the rail shaped to receive end portions of the studs from the other rail, the studs and openings being spaced so that the rake-like members can be assembled to form a ladder-like assembly with the studs passing through perforations in the paper and the rails on opposite sides of the stack. Also included is a backing strip shaped to define channels with opposed open sides which slidably receive the rails of the ladder-like assembly; and end portions of the rails adapted to engage the ends of the channels and center the ladder assembly therein.

In the device according to the present invention, however, the parts are all inexpensive polymeric moldings. The openings are sockets which freely receive end portions of the posts to maintain the studs in axial alignment normal to the rail in which they are engaged and properly space the rails (which is important for ease of handling the ladder assembly and the engaged stack of paper before they are inserted in the channels, and so that the rake-like members will be held in the ladder-like assembly by the channels even though the rake-like members are engaged with insufficient sheets of paper to fill the device) while affording ease of assembly and separation of the rake-like members. (The term "socket" as used herein means an opening defined by walls, which walls conform to the periphery of one of the studs for a predetermined axial length from its terminal end, provide only one opening for the stud into the socket, and include an end wall which limits engagement of the end portion of the stud to said predetermined axial length.)

The backing strip comprises a generally flat elongate rectangular back portion adapted to extend along the spine edge of a stack of sheets in the device, and opposed parallel rigid flange portions projecting from opposite long edges of the back portion and having opposed inwardly directed lips along their edges opposite the back portion. The flanges and the portions of the back portion adjacent thereto define the channels for slidably receiving the rails. The rails conform in shape to the inner surface of the channels, so that when the ladder-like assembly is engaged with the backing strip the rails substantially fill the channels throughout their length. This structure affords a binding device of a minimum size in which the backing strip does not project excessively from the surface of the paper being bound. This is advantageous in that when the binding device is used without an outer cover assembly the backing strip will provide a minimum interference with the backings of similar or conventionally bound stacks of sheets stored adjacent it on a shelf. Also the binding device may include a special cover assembly attached over the backing strip so that a covered stack of sheets can be provided which has about the same uniform thickness as a conventionally bound book. This cover assembly includes a central spine member attached to and co-extensive with the surface of the backing strip opposite the channels, and front and back cover members flexibly attached along the opposite edges of the spine member which extend along the flanges. The cover members have portions that are thinner than the balance thereof which thin portions extend from the spine member past the flanges on the backing strip. The binding strip according to the present invention projects such a small distance above the surface of a stack of paper filling the device that without appearing out of proportion the thickness of the cover portions extending beyond the thinned sections can be about the same thickness as the combination of the rail channel and thinned section of cover on that same side to produce a uniform thickness for a bound and covered stack of sheets.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENTS

Figure 1:
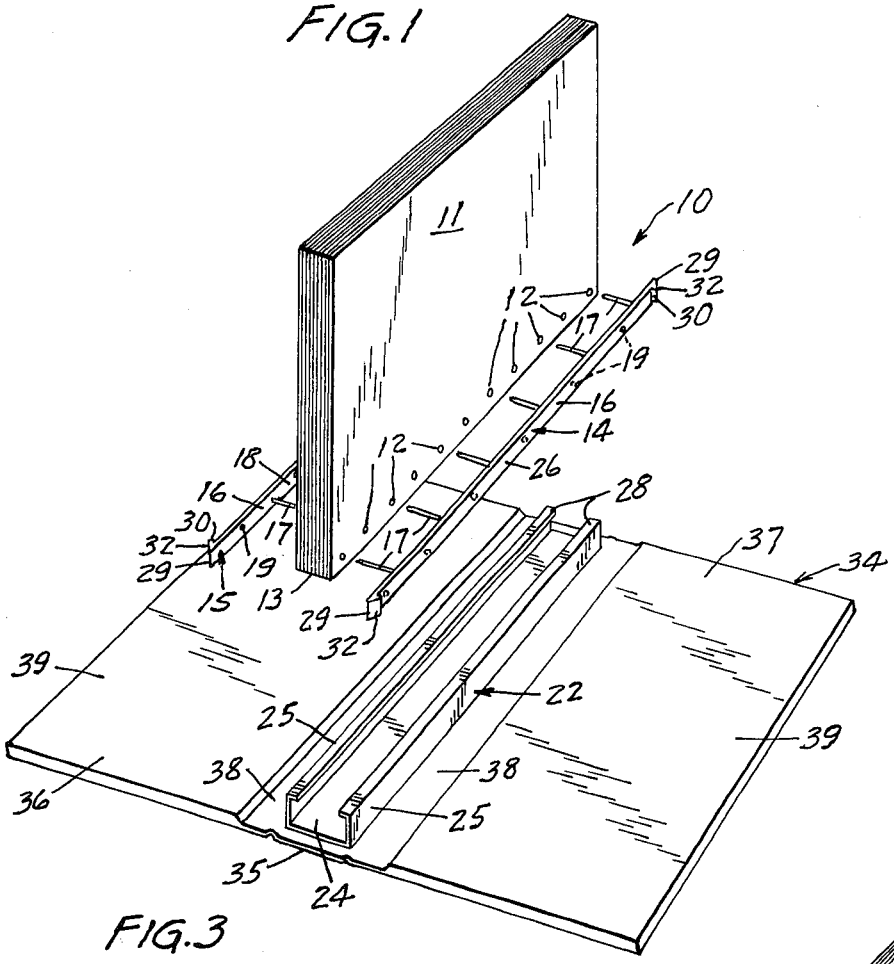
FIG. 1 is an exploded perspective view of a releasable binding device according to the present invention shown with a perforated stack of paper.
Figure 3:
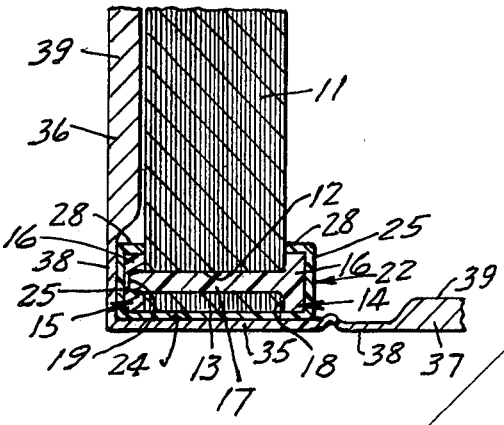
FIG. 3 is a sectional view taken approximately along lines 3—3 of FIG. 2, but shown with one member of a cover assembly on the binding device in a closed position.

Referring now to FIGS. 1 through 5 there is illustrated a first embodiment of a binding device according to the present invention, generally designated by the reference numeral 10. The device 10 is adapted to bind together a stack of paper 11 having a row of spaced perforations 12 punched through the stack along and parallel to one edge surface 13 designated the spine edge surface herein.

Figure 2:
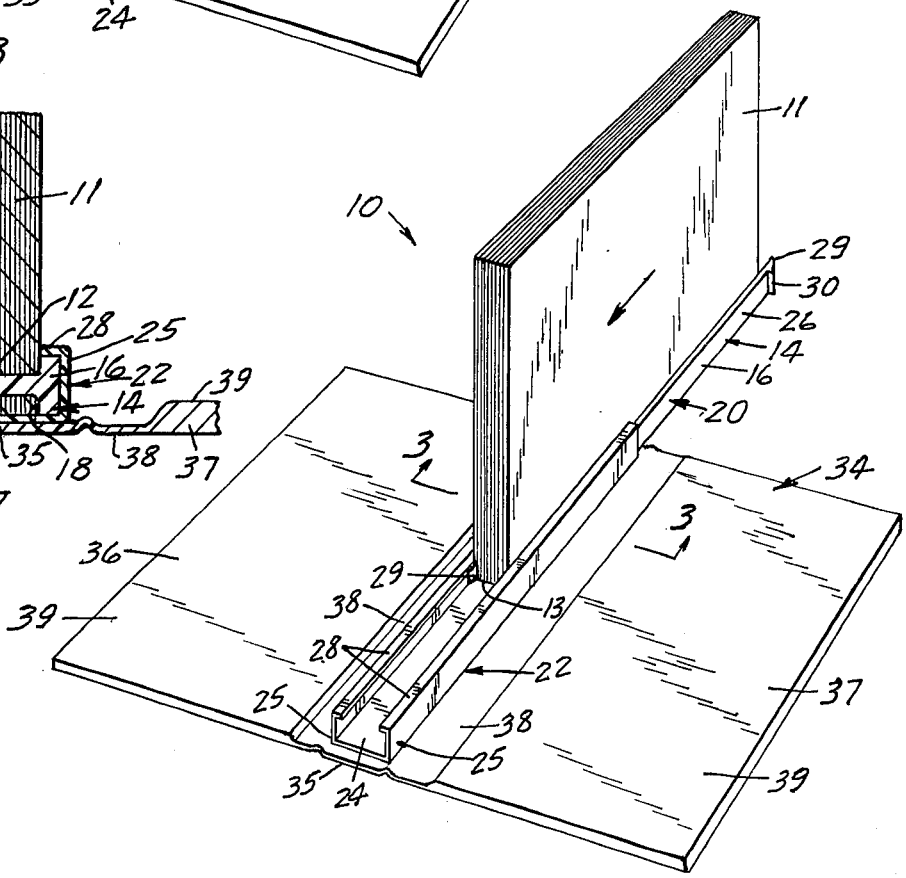
FIG. 2 is a view of the binding device of FIG. 1 being assembled to bind the stack of paper.
Figure 4:
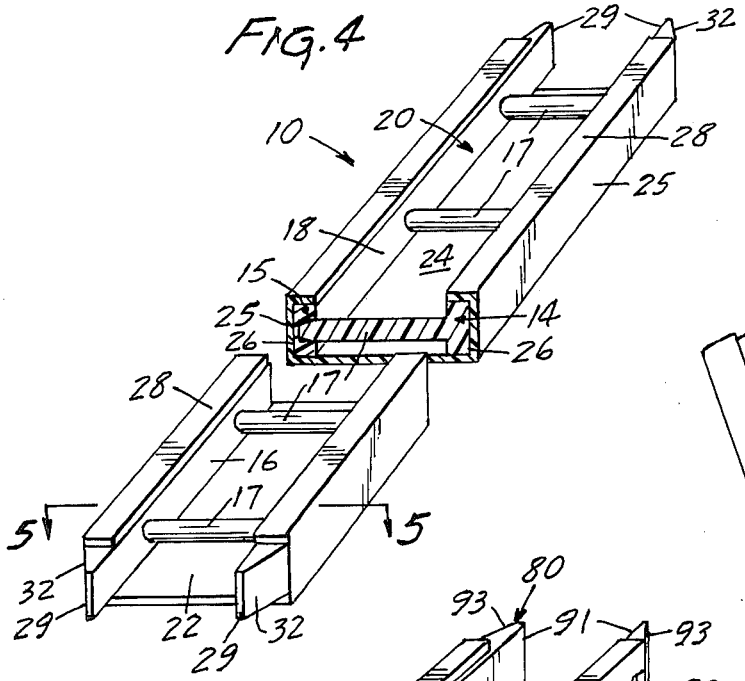
FIG. 4 is an enlarged fragmentary view with parts in section illustrating the device of FIG. 1 without a cover assembly attached.

As is best seen in FIGS. 1 and 2 the device 10 includes first and second rake-like members 14 and 15 each comprising an elongate rail 16 of a resilient flexible material and having a rectangular cross section, and a plurality of spaced parallel cylindrical studs 17 aligned along and projecting normal to a first major side surface 18 of the rail 16. The studs 17 on each rail 16 are adapted to pass through every other perforation 12 in the stack of paper 11 with the studs on each of the rake-like members 14 and 15 inserted from a different side of the stack of paper 11, and with the end portions on the studs 17 of each rake-like member 14 or 15 being received in sockets 19 opening through the first side surface 18 of the rail 16 on the other rake-like member 14 or 15. The sockets 19 are aligned with and spaced from the studs 17 so that the two rake-like members 14 and 15 thus engaged can form a ladder-like assembly 20 with the ends of the rails opposite each other, the studs in the perforations 12 and the rails 16 on opposite sides of the stack of paper 11.

The end portions of the studs 17 are frusto-conical in shape. The sockets 19 conform to and receive the end portions of the studs 17 with a fairly close fit and have a predetermined depth so that such engagement of the stud end portions and sockets 19 maintains the studs 17 in a position normal to the surface 18 of the rail 16 in which they are received and limits movement of the rails 16 toward each other to position the rails 16 at a predetermined spacing from each other. Thus the ladder-like assembly 20 and the stack of paper 11 which the studs 17 engage can be easily handled and prevented from coming apart by maintaining finger pressure to urge the rails 16 toward each other.

The device also includes a backing strip 22 adapted for holding the rake-like members 14 and 15 of the ladder-like assembly 20 together when the binding device 10 is assembled. The backing strip 22 is shaped to define two channels with opposed open sides adapted to slidably receive the rails 16 of the ladder-like assembly 20 and maintain them in spaced relationship with the backing strip 22 extending around the spine edge 13 of the stack of paper 11, and the stack of paper 11 projecting between spaced edges of the channels.

The backing strip 22 is a thin walled elongate polymeric extrusion comprising an elongate rectangular back portion 24 and opposed parallel rigid flange portions 25 projecting from opposite long edges of the back portion 24. The opposed inner surfaces of the flange portions 25 are spaced at about the same distance as the surfaces 26 of the rails 16 opposite the studs 17 when the rake-like members 14 and 15 are assembled into the ladder-like assembly 20 so that when the rails 16 are between the inner surfaces of the flange portions 25 the ends of the studs 17 will be maintained in engagement with the sockets 19. Also the flange portions 25 have opposed inwardly projecting lips 28 on their edges opposite the back portions 24. The lips 28 are spaced apart to allow the stack of paper 11 on the ladder-like assembly 20 in the channels to project therebetween, and engage the surfaces opposite the back portion 24 of the rails 16 in the ladder-like assembly 20 to prevent the ladder-like assembly 20 and the stack of paper 11 engaged therein from being pulled out of the backing strip 22 in a direction normal to the back portion 24.

Figure 5:
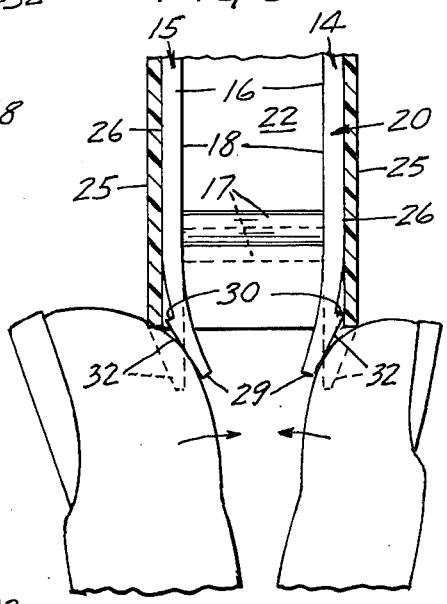
FIG. 5 is an enlarged section of a fragment of the device taken approximately along line 5—5 of FIG. 4, and illustrating the release of a ladder-like assembly of the device from a backing strip of the device.

The binding device 10 also includes means for releasably retaining the ladder-like assembly 20 in the backing strip 22. End portions 29 of the rails 16 include a ledge 30 projecting from the surface 26 of the rails 16 opposite the studs 17. Each ledge 30 projects a distance approximately equal to the thickness of one of the flanges 25, faces the end of the rail 16 opposite the end portion 29 of which it is a part, and has a length no greater than the width of the surface 26 that it traverses. The ledges 30 on each rail 16 are opposed and spaced apart a distance about equal to the length of the flanges 25, and are adapted to engage over the ends of the flanges 25 when the ladder-like assembly 20 is longitudinally centered in the backing strip 22. Each of the end portions 29 of the rails 16 also has a generally planar cam surface 32 extending from its ledge 30 to the adjacent terminal end of the rail 16 and disposed at an acute angle with respect to the elongate side surface 26 of the rail 16. The cam surfaces 32 provide means for camming two opposed end portions 29 on the ladder-like assembly 20 toward each other to afford entry of the end portions 29 and the following portions of the ladder-like assembly 20 between the ends of the flanges 25 when the ladder-like assembly 20 is inserted and urged therebetween. Also the cam surfaces 32 facilitate disassembly of the ladder-like assembly 20 from the backing strip 22. To disassemble the binding device 10, the user presses his fingers together against two opposite camming surfaces 32 at one end of the ladder-like assembly 20 (FIG. 5). The opposite camming surfaces 32 are outwardly disposed and inclined with respect to the direction of relative sliding movement between the ladder-like assembly 20 and the backing strip 22 so that such finger pressure both moves the opposite end portions 29 of the rails 16 toward each other to disengage the ledges 30 thereon from the ends of the flanges 25, and directs a component of the applied finger pressure to slide the ledges 30 on the engaged end portions 29 into the backing strip 22 to approximately the position shown in FIG. 5. The ledges 30 of the engaged end portions 29 are then positioned inside the flanges 25 which retain the end portion 29 in a deflected position so that the user may then simply slide the ladder-like assembly 20 longitudinally out of the backing strip 22 and disengaging the rake-like members 14 and 15 to remove or add sheets.

The following example which lists approximate dimensions will illustrate the small unobtrusive size of a binding device according to the present invention. Rails $\frac{1}{4}$ inch by 3/32 inch in cross section and $11\frac{1}{8}$ inch long support $\frac{1}{8}$ inch diameter 11/16 inch long studs on 2 inch centers. The end portions of the studs are received in sockets 5/64 inch deep spaced one inch from an adjacent stud. The end portions of each rail from the ledge to the adjacent terminal end are 7/32 inch long and the camming surface thereon is disposed at an angle of 30° with the surface of the rails. The walls of the backing strip are 1/32 inch thick. Thus the combined height of the flanges and rail above a stack of perforated paper which fills the binding device is only about $\frac{1}{8}$ inch.

The binding device 10 also comprises a cover assembly 34 including a spine member 35 about co-extensive with and attached to the surface of the back portion 24 opposite the flanges 25, and front and back cover members 36 and 37 adapted to be co-extensive with and to project past the side surfaces of the stack of paper 11. The front and back cover members 36 and 37 are flexibly attached to the edges of the spine member 35 which extend along the flanges 25. Each has a thin flexible portion 38 which extends from the edge of the spine member 35 past the adjacent flange 25 and the thicker stiff portion 39 adapted to cover the portion of a stack of paper 11 extending beyond the flanges 25. The thickness of the stiff portion 39 is about the same as the combination of the rail 16, flange 25 and thin portion 38 so that a binding device 10 containing a stack of paper 11 of maximum thickness is of approximately a uniform thickness between the outer surfaces of the cover members 36 and 37.

Figure 6:
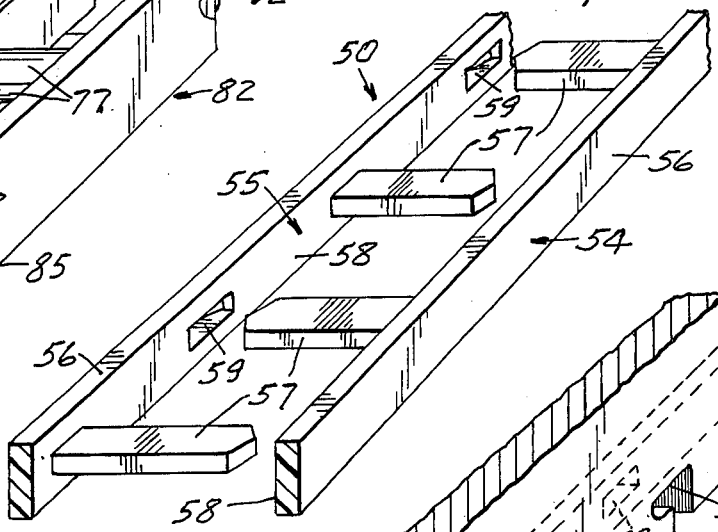
FIG. 6 is a fragmentary view of an alternate embodiment of two rake-like members included in the device of FIG. 1.
Figure 7:
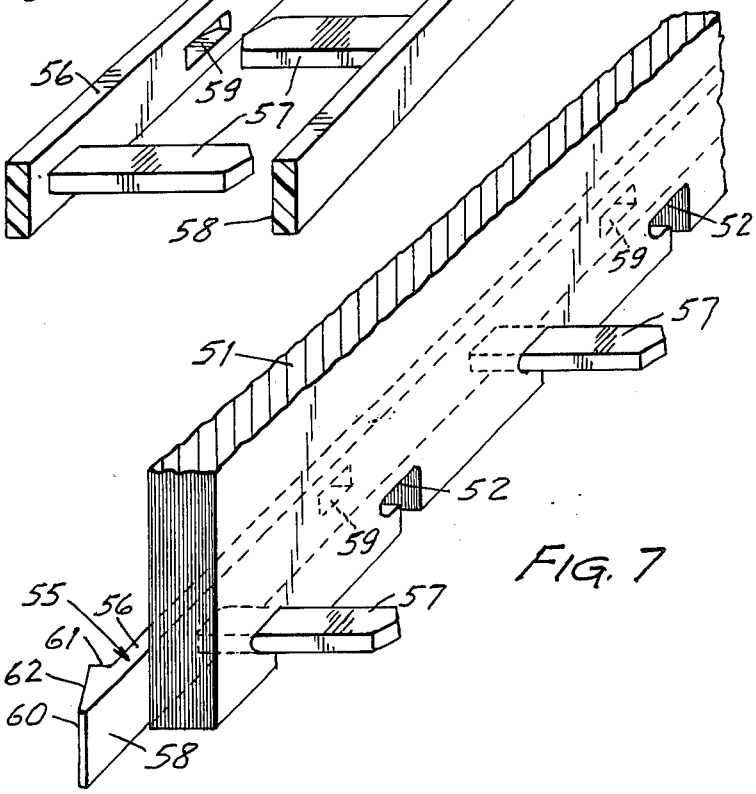
FIG. 7 is a fragmentary view of one of the rake-like members of FIG. 6 shown engaged with a fragment of a stack of paper having special perforations for which the rake-like members are adapted.

Referring now to FIGS. 6 and 7 there is illustrated a second embodiment of a ladder-like assembly 50 which may be substituted for the ladder-like assembly 20 to form a binding device according to the present invention. The ladder-like assembly 50 includes first and second rake-like members 54 and 55 each comprising an elongate rail 56 of a resilient flexible material and having a rectangular cross section, and a plurality of spaced parallel rectangular studs 57 aligned along and projecting normal to a first major side surface 58 of the rail 56. The rectangular studs 57 on each rail 56 are particularly adapted to pass through spaced portions of a spaced series of generally L-shaped perforations 52 cut into a stack of paper 51 from a spine edge surface thereof, as by the device taught in U.S. patent application No. 618,899, now U.S. Pat. No. 3,975,975 the content whereof is incorporated herein by reference. To engage the ladder-like assembly 50 with the stack of paper 51 the studs 57 on each of the rake-like members 54 and 55 are inserted from a different side of the stack of paper 51. The end portions on the studs 57 of each rake-like member 54 or 55 are received in sockets 59 opening through the first side surface 58 of the rail 56 on the other rake-like member 54 or 55. The sockets 59 are aligned with and spaced from the studs 57 so that the two rake-like members 54 and 55 thus engaged form the ladder-like assembly 50 with the ends of the rails 56 opposite each other, the studs 57 in the perforations 52 and the rails 56 on opposite sides of the stack of paper 11.

In the ladder-like assembly 50 the end portions of the studs 57 are pointed and as with the sockets 19 of the ladder-like assembly 20, the sockets 59 receive the end portions of the studs 57 with a fairly close fit and have a predetermined depth so that such engagement of the stud end portions and sockets 59 maintains the studs 57 in a position normal to the surface 58 of the rail 56 in which they are received and limits movement of the rails 56 toward each other to position the rails 56 at a predetermined spacing from each other. Also each end of each rail 56 has an end portion 60 having a ledge 61 and a cam surface 62 shaped and disposed like the ledges 30 and cam surfaces 32 of the ladder-like assembly 20.

Figure 8:
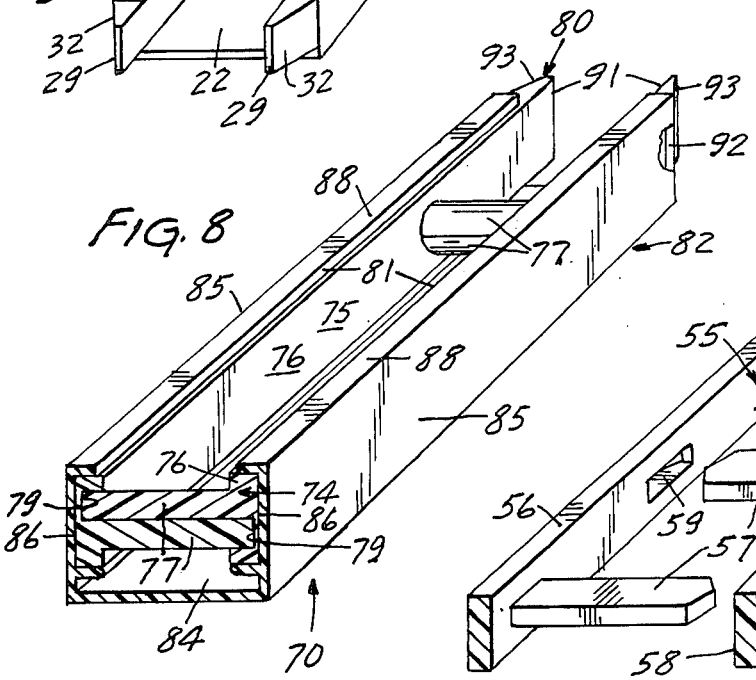
FIG. 8 is a fragmentary view, with parts in section, of an alternate embodiment of the binding device.

Referring now to FIG. 8 there is shown a binding device 70 having many similarities to the device 10, but which is particularly adapted for use with a stack of paper having three perforations sized and spaced for the ubiquitous three-ring binder (i.e. about $\frac{1}{4}$ inch diameter round perforations on $\frac{1}{4}$ inch centers which are spaced at least $\frac{1}{4}$ inch from the spine edge of the stack of sheets). The device 70 includes first and second rake-like members 74 and 75 each comprising an elongate rail 76 of a resilient flexible material and having a rectangular cross section, and three spaced parallel half-cylindrical studs 77 aligned along and projecting normal to a first major side surface 78 of the rail 76. The studs 77 on each rail 76 are adapted to pass through all three perforations in the stack of paper having the three perforations with the studs 77 on each of the rake-like members 74 and 75 inserted from a different side of the paper, and with the studs 77 of each rake-like member 74 or 75 complementing the studs 77 of the other to form cylindrical stud assemblies through the perforations. Tapered end portions on the studs 77 on each rail 76 are received in sockets 79 opening through the first side surface 78 of the rail 76 on the other rake-like member 74 or 75. Such assembly of the two rake-like members 74 and 75 forms a ladder-like assembly 80 with the ends of the rails 76 opposite each other, the studs in the perforations 72 and the rails 76 on opposite sides of the stack of paper. The sockets 79 conform to and receive the tapered end portions of the studs 77 with a fairly close fit and have a predetermined depth so that such engagement of the stud end portions and sockets 79 maintains the studs 77 in a position normal to the surface 78 of the rail 76 in which they are received and limits movement of the rails 76 toward each other to position the rails 76 at a predetermined spacing from each other.

The three studs 77 on each rail 76 are desirable to help align sheets on the studs 77 when the rake-like members 74 and 75 are separated to change or collect sheets, which alignment would not be provided on a single stud if the alternating stud design of the binding device 10 were used in the binding device 70.

Like the device 10, the device 70 also includes a backing strip 82 adapted for holding the rake-like members 74 and 75 of the ladder-like assembly 80 together when the binding device 70 is assembled. The backing strip 82 is shaped to define two channels with opposed open sides adapted to slidably receive the rails 76 of the ladder-like assembly 80 and maintain them in spaced relationship with the backing strip 82 extending around the spine edge of a stack of paper, and the stack of paper projecting between spaced edges 81 of the channels.

Like the backing strip 22, the backing strip 82 is a thin walled elongate polymeric extrusion comprising an elongate rectangular back portion 84 and opposed parallel rigid flange portions 85 projecting from opposite long edges of the back portion 84. The opposed inner surfaces of the flange portions 85 are spaced at about the same distance as the surfaces 86 of the rails 76 opposite the studs 77 when the rake-like members 74 and 75 are assembled into the ladder-like assembly 80 so that when the rails 76 are between the inner surfaces of the flange portions 85 the ends of the studs 77 will be maintained in engagement with the sockets 79. Also the flange portions 85 have opposed inwardly projecting lips 88 on their edges opposite the back portions 84 to prevent the ladder-like assembly 80 and a stack of paper engaged therein from being pulled out of the backing strip 82 in a direction normal to the back portion 84. Unlike the backing strip 22, however, the surface of the rails opposite the lips 88 are retained by a ridge 90 and the back portion 84 is spaced from the ridge 90 which is necessary due to the large distance the three hole perforations are inset from the spine edge of a stack of sheets.

Also, both end portions 91 of each of the rails 76 are formed with ledges 92 and cam surfaces 93 which correspond in shape and function to the ledges 30 and cam surfaces 32 of the end portions 29 of the device 10.

I claim:

1. A binding device for a stack of sheets having a plurality of spaced perforations along a spine edge surface of the stack, said device comprising;

first and second polymeric rake-like members, each rake-like member comprising an elongate rail having first and second opposite major elongate surfaces, and a plurality of spaced aligned studs projecting normally from the first surface of said rail, and a plurality of spaced sockets in the first surface of said rail, said second surface of said rail being smooth throughout its length for the portion opposite said studs and sockets, each stud having a base end attached to said rail and an opposite frustoconical terminal end, substantially all of said sockets opening through only the first surface of said rail adapted to receive terminal end portions of the studs on the other of said rails to afford mutual engagement therebetween providing a ladder-like assembly with said rails in spaced, parallel relationship and to maintain said studs in alignment, said rake-like members being adapted to engage a said stack of sheets from opposite sides with said studs extending through the perforations and into said sockets to form said ladder-like assembly;

an elongate polymeric backing strip defining channels with opposed open sides adapted to slidably receive the rails of said ladder-like assembly and constituting the sole means for holding the terminal end portions of the studs in said sockets to maintain the rake-like members in mutual engagement with the studs projecting through a said stack of sheets, said backing strip comprising a generally flat elongate rectangular back portion adapted to extend along the spine edge surface of a said stack of sheets in the device, and spaced opposed flange portions projecting from the opposite long edges of the back portion having opposed inner surfaces and opposed inwardly directed lips along their edges opposite the back portion, the spacing between said lips being adapted to receive the spine of a said stack of sheets therebetween, said lips, flange portions and the portion of said back portion adjacent thereto defining said channels for slidably receiving said ladder-like assembly and conforming in shape to the rails so that when the ladder assembly is engaged with the backing strip the rails substantially fill the channels and are in contact throughout the length of the backing strip; and means for releasably retaining said ladder-like assembly at a predetermined position longitudinally within said channels, said retaining means comprising two triangular end portions integrally formed on each of said rails, each of which end portions includes an apex forming the terminal end of said rail, a ledge remotely located from said apex and projecting at a right angle from the second surface of said rail with the ledges on both of said rails having an outer tip spaced from the rail second surface a distance far enough so that the distance between adjacent ledge outer tips of said ladder-like assembly exceeds the distance between said inner surfaces of said spaced opposed flange portions so that said ledge outer tips engage both of said backing strip flange portions to flex said rail end portions toward each other when said ladder-like assembly end portions are located within said channel, said ledges each contacting a corresponding terminal end of said opposed flange portions to lock said ladder-like assembly into said predetermined position when said ladder-like assembly is at said predetermined position, said end portions each having a flat cam surface extending from said ledge to said apex and being disposed at an acute included angle relative to said first surface, the cam surfaces on the opposite end portions at each end of said ladder-like assembly being disposed so that upon the manual application of pressure to said cam surface, the rails flex toward each other so that ledges on said adjacent end portions will each move out of engagement with said corresponding terminal end of said backing strip flange portions and into said channel.

2. A binding device for a stack of sheets having three spaced perforations along a spine edge surface, said device comprising:

first and second rake-like members, each rake-like member comprising a longitudinal rail having first and second opposite major elongate surfaces, and only three spaced half cylindrical studs each having an arcuate surface portion and an opposite surface, said studs each having a base end attached to said rail, projecting normally from the first surface of said rail, and having a terminal end portion opposite said base, said rails each having a socket at the base end of each of said studs opening through the first surface of said rail and adapted to receive terminal end portions of the studs on the other of said rails to afford mutual engagement therebetween with said opposite surfaces of the studs adjacent to provide a cylindrical stud assembly and providing a ladder-like assembly with said rails in spaced, parallel relationship, said rake-like members being adapted to engage a said stack of sheets from opposite sides with said studs through the perforations to form said ladder-like assembly;

an elongate polymeric backing strip defining channels with opposed open sides adapted to slidably receive the rails of said ladder-like assembly and constituting the sole means for holding the terminal end portions of the studs in said sockets to maintain the rake-like members in mutual engagement with the studs projecting through a said stack of sheets, said backing strip comprising a generally flat elongate rectangular back portion adapted to extend along the spine edge surface of a said stack of sheets in the device, and spaced opposed flange portions projecting from the opposite long edges of the back portion having opposed inner surfaces and opposed inwardly directed lips along their edges opposite the back portion, the spacing between said lips being adapted to receive the spine of a said stack of sheets therebetween, said lips, flange portions and the portion of said back portion adjacent thereto defining said channels for slidably receiving said ladder-like assembly and conforming in shape to the rails so that when the ladder assembly is engaged with the backing strip the rails substantially fill the channels and are in contact throughout the length of the backing strip; and means for releasably retaining said ladder-like assembly at a predetermined position longitudinally within said channels, said retaining means comprising two triangular end portions integrally formed on each of said rails, each of which end portions includes an apex forming the terminal end of said rail, a ledge remotely located from said apex and projecting at a right angle from the second surface of said rail with the ledges on both of said rails having an outer tip spaced from the rail second surface a distance far enough so that the distance between adjacent ledge outer tips of said ladder-like assembly exceeds the distance between said inner surfaces of said spaced opposed flange portions so that said ledge outer tips engage both of said backing strip flange portions to flex said rail end portions toward each other when said ladder-like assembly end portions are located within said channel, said ledges each contacting a corresponding terminal end of said opposed flange portions to lock said ladder-like assembly into said predetermined position when said ladder-like assembly is at said predetermined position, said end portions each having a flat cam surface extending from said ledge to said apex and being disposed at an acute included angle relative to said first surface, the cam surfaces on the opposite end portions at each end of said ladder-like assembly being disposed so that upon the manual application of pressure to said cam surface, the rails flex toward each other so that ledges on said adjacent end portions will each move out of engagement with said corresponding terminal end of said backing strip flange portions and into said channel.

* * * * *